US010586498B2

(12) United States Patent
Ryu

(10) Patent No.: US 10,586,498 B2
(45) Date of Patent: Mar. 10, 2020

(54) SOURCE DRIVER AND DISPLAY APPARATUS INCLUDING THE SAME

(71) Applicant: DB HiTek Co., Ltd, Seoul (KR)

(72) Inventor: Choong Sik Ryu, Anyang-si (KR)

(73) Assignee: DB Hitek Co., Ltd., Seoul (KR)

( * ) Notice: Subject to any disclaimer, the term of this patent is extended or adjusted under 35 U.S.C. 154(b) by 0 days.

(21) Appl. No.: 16/018,901

(22) Filed: Jun. 26, 2018

(65) Prior Publication Data

US 2019/0189061 A1 Jun. 20, 2019

(30) Foreign Application Priority Data

Dec. 14, 2017 (KR) ..... 10-2017-0172366

(51) Int. Cl.
*G09G 3/34* (2006.01)

(52) U.S. Cl.
CPC ..... *G09G 3/34* (2013.01); *G09G 2310/0278* (2013.01); *G09G 2310/0289* (2013.01)

(58) Field of Classification Search
CPC ..... G09G 2310/0272; G09G 2310/027; G09G 2310/0291; G09G 3/34; G09G 2310/0278; G09G 2310/0289
See application file for complete search history.

(56) References Cited

U.S. PATENT DOCUMENTS

2005/0190127 A1* 9/2005 Tomohara ..... G09G 3/20 345/76
2006/0192793 A1* 8/2006 Kato ..... G09G 3/3685 345/690
2011/0261084 A1* 10/2011 Tu ..... G09G 3/3688 345/690

* cited by examiner

*Primary Examiner* — Md Saiful A Siddiqui
(74) *Attorney, Agent, or Firm* — Andrew D. Fortney; Central California IP Group, P.C.

(57) ABSTRACT

A source driver includes a latch configured to store data based on or in response to a latch signal and output the data stored in the latch, a resistor string including a plurality of resistors configured to provide a plurality of grayscale voltages, a decoder connected to the resistor string, configured to select and output one of the plurality of grayscale voltages based on or in response to the data from the latch, an amplifier including a first input terminal, a second input terminal and an output terminal, a first control switch between the decoder and the first input terminal of the amplifier, and a second control switch between the first input terminal and the second input terminal of the amplifier. The first control switch and the second control switch are alternately turned on and off.

18 Claims, 5 Drawing Sheets

SOURCE DRIVER AND DISPLAY APPARATUS INCLUDING THE SAME

This application claims the benefit of Korean Patent Application No. 10-2017-0172366, filed on Dec. 14, 2017, which is hereby incorporated by reference as if fully set forth herein.

BACKGROUND OF THE INVENTION

Field of the Invention

Embodiments of the present invention relate to a source driver and a display apparatus including the same.

Discussion of the Related Art

A source driver may include latches for driving source lines of a display panel and storing data, level shifters for shifting the voltage level of the stored data, digital-to-analog converters (or decoders) for converting the level-shifted data into analog signals, a resistor string (R-string) for providing a plurality of grayscale voltages and output buffers for amplifying and outputting the analog signals to the source lines.

The source driver may restore latch signals or latch enable signals from clock embedded data received from a timing controller and send the restored latch signals or latch enable signals to the latches. When the latch enable signals are input to the latches, the output buffers may receive the grayscale voltages.

The latch enable signals may not be simultaneously transmitted to the latches corresponding to all channels of the source driver. In this case, the latch enable signals may be spread or delayed, and then transmitted to the latches. Thus, the latches may operate at various times or over various time intervals.

Each of the decoders may select any of the plurality of grayscale voltages provided by the resistor string based on or in response to data stored in a corresponding one of the latches. However, since the decoders use a common resistor string, the common resistor string may fluctuate due to a short circuit that may form when the decoders select the grayscale voltages.

As described above, since the latch enable signals are spread over a time interval, the decoders select grayscale voltages over a time interval. As the latch enable signals are spread over time, the common resistor string continues to fluctuate and may not maintain an accurate resistance value.

The source driver may include the decoders, respectively corresponding to the channels, and may include a common connection line for connecting the channels with the common resistor string.

Fluctuation of the resistor string during the latch enable signal spread time may be further delayed by (i) a resistance component of the common connection line and (ii) an increase in time required for the resistor string to reach an accurate resistance value.

Accordingly, the grayscale voltages may be distorted due to fluctuations in the resistor string, the output of which is transmitted to a decoder corresponding to a latch to which the latch enable signal may not yet be transmitted or asserted. Thus, the output buffer may not maintain a current state and may buffer, amplify and/or output the distorted grayscale voltage received from the decoder.

SUMMARY OF THE INVENTION

Accordingly, embodiments of the present invention are directed to a source driver and a display apparatus including the same that substantially obviate one or more problems due to limitations and disadvantages of the related art.

An object of the embodiments of the present invention is to provide a source driver capable of preventing output distortion in a signal from a decoder and/or an amplifier due to fluctuations in a resistor string by a decoder switching process or operation that may occur when a latch signal is transmitted to a channel in response to a latch enable signal. Embodiments of the present invention also include a display apparatus including the source driver.

Another object of the embodiments of the present invention is to provide a source driver capable of preventing a gray inversion phenomenon between neighboring even-numbered and odd-numbered interpolated rows or columns of grayscale data (which may be generated in a decoder to which interpolation is applied) from affecting the output of the amplifier. Embodiments of the present invention also include a display device including the source driver.

Additional advantages, objects, and features of the invention will be set forth in part in the description which follows and in part will become apparent to those skilled in the art upon examination of the following or may be learned from practice of the invention. The objectives and other advantages of the invention may be realized and attained by the structure(s) particularly pointed out in the written description and claims hereof, as well as the appended drawings.

To achieve these objects and other advantages and in accordance with the purpose(s) of the invention, as embodied and broadly described herein, the source driver includes (a) a latch configured to store data based on or in response to a latch signal (e.g., a latch enable signal) and output the data stored in the latch, (b) a resistor string including a plurality of resistors configured to provide a plurality of grayscale voltages, (c) a decoder connected to the resistor string, configured to select and output one of the plurality of grayscale voltages based on or in response to the data from the latch, (d) an amplifier including a first input terminal, a second input terminal and an output terminal, (e) a first control switch connected between the decoder and the first input terminal of the amplifier, and (f) a second control switch connected between the first input terminal and the second input terminal of the amplifier. The first control switch and the second control switch are alternately turned on and off (e.g., when one of the first and second control switches is on, the other is off).

The first control switch may be controlled by a first control signal and the second control switch may be controlled by a second control signal that is an inverted first control signal.

The first control switch may be controlled by a first control signal synchronized with the latch signal.

The first control switch may be controlled by a first control signal delayed from the latch signal by a predetermined delay time.

The decoder may include a plurality of switches connected to the resistor string, and the plurality of switches may be configured to select one of the plurality of grayscale voltages based on or in response to the data stored in the latch.

The source driver may further include an output pin and an output switch connected between the output pin and the output terminal of the amplifier, and the output switch may be turned on when the latch is enabled (e.g., when the latch enable signal is asserted).

The amplifier may be or comprise a buffer, and the second input terminal and the output terminal of the amplifier may be connected.

According to one or more other embodiments of the present invention, the source driver includes a plurality of pins, a resistor string including a plurality of resistors configured to provide a plurality of grayscale voltages, and a plurality of drivers configured to provide drive signals to the plurality of pins. Each of the plurality of drivers includes a latch configured to store data based on or in response to a corresponding one of a plurality of latch signals (e.g., latch enable signals) and output the data stored in the latch, a decoder connected to the resistor string configured to select and output one of the plurality of grayscale voltages based on or in response to the data from the latch, an amplifier including a first input terminal, a second input terminal and an output terminal, a first control switch connected between an output of the decoder and the first input terminal of the amplifier, and a second control switch connected between the first input terminal and the second input terminal of the amplifier. The first control switch of each of the drivers is controlled by a first control signal generated based on or generated in response to a corresponding one of the plurality of latch signals. The first control switch and the second control switch in each of the plurality of drivers may be alternately switched (e.g., when one of the first and second control switches is on, the other is off).

The first control signal may be synchronized with the corresponding latch signal.

The first control signal may be delayed from the corresponding latch signal by a predetermined delay time.

The decoder may include a plurality of switches connected to the resistor string, and the plurality of switches may be configured to select one of the plurality of grayscale voltages based on or in response to the data stored in the latch.

The source driver may further include a plurality of output pins, each output pin corresponding to a unique one of the plurality of drivers, and a plurality of output switches, each output switch connected between the output terminal of a corresponding amplifier of the unique one of the plurality of drivers and a corresponding one of the output pins. The output switch(es) may be turned on when the corresponding latch(es) is/are enabled.

In a first process or operation, the first control switch in each of the plurality of drivers may be turned off, and the second control switch in each of the plurality of drivers may be turned on.

In a second process or operation subsequent to the first process or operation, the first control switches may be sequentially turned on, and the second control switches may be sequentially turned off.

The source driver may further include a multiplexer configured to provide (i) an output of one of the decoders in a selected pair of the plurality of drivers to one of the amplifiers in the selected pair of the plurality of drivers, and (ii) an output of the other one of the decoders in the selected pair of the plurality of drivers to the other one of the amplifiers in the selected pair of the plurality of drivers.

The first process or operation may be performed while the latch is not enabled.

The second process or operation may be performed while the latch is enabled.

When a first driver of the plurality of drivers selects one of the plurality of grayscale voltages, the first control switch of the first driver may be turned on and the second control switch of the first driver may be turned off, the first control switch of a second driver of the plurality of the drivers may be turned off and the second control switch of the second driver may be turned on, and the latch of the second driver may not receive a corresponding one of the plurality of latch signals.

Each of the plurality of drivers may further include a level shifter configured to shift a level (e.g., a voltage level) of the data in the latch and output the level-shifted data to the decoder.

According to one or more other embodiments of the present invention, a display apparatus includes a display panel including gate lines, data lines, and pixels connected to the gate lines and the data lines, the pixels being in a matrix including rows and columns, a data driver configured to drive the data lines, and a gate driver configured to drive the gate lines. The data driver is or comprises the source driver according to one or more embodiments of the present invention.

It is to be understood that both the foregoing general description and the following detailed description of various embodiments of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Figure 1:
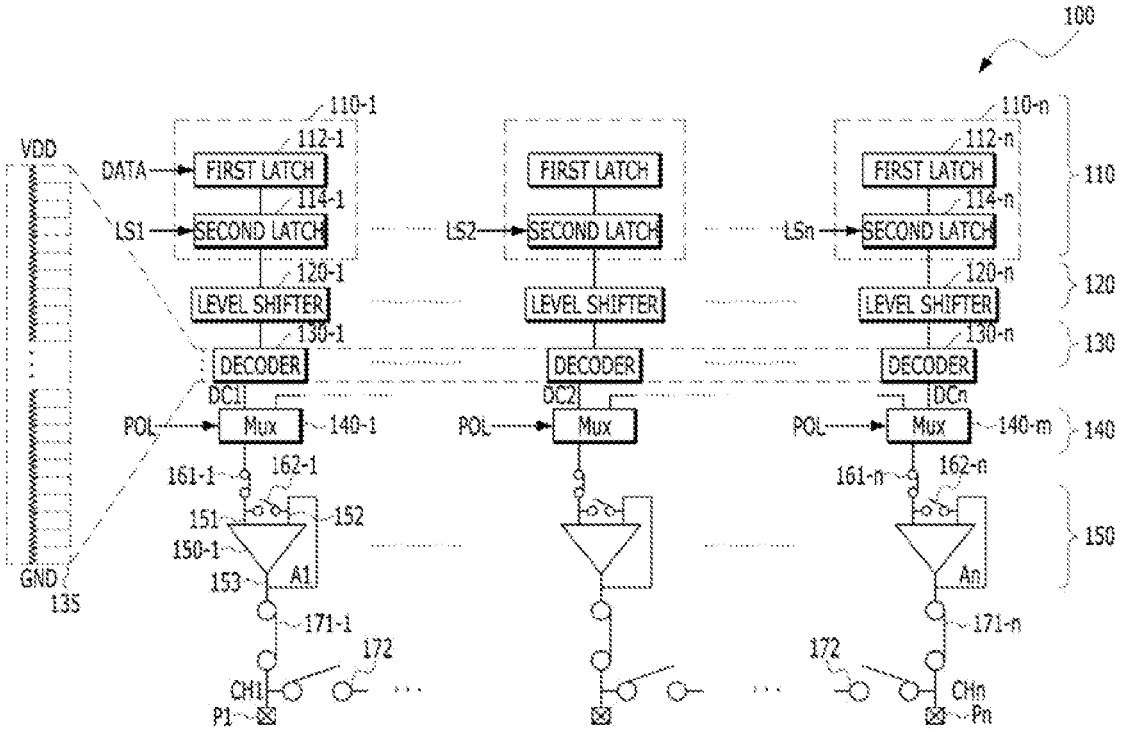
FIG. 1 is a diagram showing a configuration of an exemplary source driver according to one or more embodiments of the invention.

Reference will now be made in detail to embodiments of the present invention, examples of which are illustrated in the accompanying drawings.

In the following description of various embodiments, it will be understood that, when an element is referred to as being "on" or "under" another element, it can be directly on or under another element or can be indirectly on or under the other element with intervening elements therebetween. Furthermore, when the expression "on" or "under" is used herein, it may include the upward direction and the downward direction with reference to an element.

In addition, it will be understood that relative terms used hereinafter, such as "first" and "second" "on"/"above"/"over" and "under"/"below"/"beneath" may be construed only to distinguish one element from another element without necessarily requiring or involving a certain physical or logical relationship or sequence between the elements. In addition, the same reference numerals will be used throughout the drawings to refer to the same or like parts.

The terms "including", "comprising", "having" and variations thereof disclosed herein mean "including but not limited to" unless expressly specified otherwise, and, as such, should not be construed to exclude elements other than the elements disclosed herein and should be construed to further include additional elements. In addition, the terms "corresponding" and variations thereof disclosed herein may involve at least one of the meanings of "facing," "overlapping" and "in a unique or 1:1 relationship with."

FIG. 1 is a diagram showing the configuration of an exemplary source driver 100 according to one or more embodiments of the present invention.

Referring to FIG. 1, the source driver 100 may include a latch unit 110, a level shifter unit 120, a decoder unit 130, a reference voltage generator 135, a multiplexer unit 140, an output unit 150, first control switches 161-1 to 161-n (n being a natural number greater than 1), second control switches 162-1 to 162-n (n being a natural number greater than 1) and output switches 171-1 to 171-n (n being a natural number greater than 1).

The source driver 100 may further include output pads (or output pins) P1 to Pn and one or more charge sharing switches 172.

The plurality of output pins P1 to Pn may be connected to the data lines of a panel 201 (FIG. 7) and a plurality of drivers configured to provide drive signals to the plurality of pins P1 to Pn. That is, each of the plurality of drivers may drive a corresponding one of a plurality of channels CH1 to CHn (n being a natural number greater than 1), for example in and/or to the panel 201.

For example, the drive signals of the plurality of drivers may be output from the output terminals 153 of the amplifiers 150-1 to 150-n (FIG. 1).

The plurality of channels CH1 to CHn (n being a natural number greater than 1) may correspond to the columns of the panel 201 (FIG. 7) driven by the drivers of the source driver 100.

In various embodiments, the plurality of drivers of the source driver 100 may include latches 110-1 to 110-n, level shifters 120-1 to 120-n, decoders 130-1 to 130-n, amplifiers 150-1 to 150-n, first control switches 161-1 to 161-n, second control switches 162-1 to 162-n and output switches 171-1 to 171-n. An individual source driver unit may include a latch (e.g., 110-1), a corresponding level shifter (e.g., 120-1), a corresponding decoder (e.g., 130-1), a corresponding amplifier (e.g., 150-1), a corresponding first control switch (e.g., 161-1), a corresponding second control switch (e.g., 162-1) and a corresponding output switch (e.g., 171-1).

The latch unit 110 stores data based on or in response to latch signals LS1 to LSn and outputs the stored data. The latch signals LS1 to LSn may be or comprise latch enable signals, and the latches 110-1 to 110-n may output the data stored therein in response to the latch signals LS1 to LSn.

The latch unit 110 may include a plurality of latches 110-1 to 110-n (n being a natural number greater than 1) configured to store data DATA received from a timing controller 205.

For example, the latch unit 110 may include first latches 112-1 to 112-n and second latches 114-1 to 114-n (n being a natural number greater than 1) corresponding to the first latches 112-1 to 112-n.

The first latches 112-1 to 112-n may store the data DATA received from the timing controller 205.

The second latches 114-1 to 114-n may receive and store the data from the first latches 112-1 to 112-n based on or in response to the latch signals LS1 to LSn and output the stored data (e.g., as described above).

For example, the latch signals LS1 to LSn may be or comprise signals restored or recovered from clock-embedded data (e.g., a data signal from which a clock or other timing signal may be recovered using, for example, a conventional clock-data recovery circuit) received from the timing controller 205, and may be or comprise signals configured to control timing when the data in the second latches 114-1 to 114-n are output (e.g., to the data lines of the display panel). In some embodiments, each of the first and second latches 112-1 to 112-n and 114-1 to 114-n may comprise a register (e.g., a shift register) configured to store a plurality of bits of data (e.g., 2 or more bits, such as $2^x$ bits, where x is an integer of 3 or more, such as 3-7), and each of the second latches 114-1 to 114-n may be identical or substantially identical to the corresponding first latches 112-1 to 112-n.

The source driver 100 may further include a shift register configured to receive a horizontal start signal, shift the horizontal start signal in response to a clock signal CLK, and generate the latch signals LS1 to LSn. The horizontal start signal may be used interchangeably with a start signal (e.g., for the display 201).

In addition, the data in the second latches 114-1 to 114-n may be level-shifted by the corresponding level shifter 120-1 to 120-n based on or in response to the latch signals LS1 to LSn, and the level-shifted data may be transmitted to the decoders 130-1 to 130-n.

The level shifter unit 120 shifts the levels (for example, the voltage levels) of the data from the second latches 114-1 to 114-n and outputs the level-shifted data to the decoder unit 130. For example, the level shifter unit 120 may convert the data from the second latches 114-1 to 114-n having a first level to data having a second level higher or greater than the first level.

For example, the level shifter unit 120 may include a plurality of level shifters 120-1 to 120-n corresponding to the second latches 114-1 to 114-n. The number of level shifters may be equal to the number of first latches and/or the number of second latches, without being limited thereto.

For example, each of the level shifters 120-1 to 120-n may shift the (voltage) level of the data from a corresponding one of the plurality of second latches 114-1 to 114-n and output the level-shifted data to a corresponding one of the plurality of decoders 130-1 to 130-n.

The decoder unit 130 may convert the digital signals output from the level shifter unit 120 to analog signals.

The reference voltage generator 135 generates a plurality of reference voltages (for example, grayscale voltages). For example, the reference voltage generator 135 may comprise and/or be implemented by a resistor string (R-string) including a plurality of resistors connected in series between a first voltage source VDD and a ground voltage source or the ground GND and may generate a plurality of reference voltages or grayscale voltages divided into a plurality of steps (e.g., 256 steps, or more broadly, 2Y steps, where y is an integer of 5 or more, such as 5-10).

The decoder unit 130 may select and output one of the plurality of grayscale voltages from the reference voltage generator 135 based on or in response to the digital signal output from the level shifter unit 120.

The decoder unit 130 may include the decoders 130-1 to 130-n corresponding to the second latches 114-1 to 114-n and/or the level shifters 120-1 to 120-n.

Each of the decoders 130-1 to 130-n may select and output one of the plurality of grayscale voltages from the reference voltage generator 135 based on or in response to the data output from a corresponding one of the plurality of second latches 114-1 to 114-n and/or the level shifters 120-1 to 120-n.

For example, one resistor string may comprise or be implemented as the reference voltage generator 135 may be shared among the decoders 130-1 to 130-n.

For example, the source driver 100 may include a common connection line (not shown in FIG. 1) connecting the decoders 130-1 to 130-n to the resistor string 135.

In addition, the decoders 130-1 to 130 n may include a plurality of switches (not shown) electrically connected to the resistor string of the reference voltage generator 135.

The switches in the decoders 130-1 to 130-n may be turned on or off based on or in response to the data from a corresponding one of the second latches 114-1 to 114-n and/or a corresponding one of the level shifters 120-1 to 120-n, thereby determining the output voltages of the decoders 130-1 to 130-n.

The multiplexer unit 140 outputs the output signal from one of the plurality of decoders 130-1 to 130-n to one (e.g., a corresponding one) of the plurality of amplifiers 150-1 to 150-n in the output unit 150 based on or in response to a polarity control signal POL.

For example, the multiplexer unit 140 may include a plurality of multiplexers 140-1 to 140-m (m being a natural number greater than 1 and less than n). The multiplexer unit 140 may be configured to perform a signal inversion (for example, dot inversion, line inversion, etc.) with respect to the display panel (e.g., panel 201 of FIG. 7).

For example, each of the plurality of multiplexers 140-1 to 140-m (m being a natural number greater than 1 and less than n) may provide the output of one of the two selected decoders to one of the two amplifiers corresponding to the two selected decoders based on or in response to the polarity control signal POL, and provide the output of the other of the two selected decoders to the other of the two amplifiers.

For example, the two selected decoders may be two neighboring decoders (for example, 130-(n-1) and 130-n, n being a natural number greater than 1) among the plurality of decoders 130-1 to 130-n, without being limited thereto.

The output unit 150 may amplify or buffer the analog signal from the multiplexer unit 140 and output an amplified or buffered signal.

For example, the output unit 150 may include amplifiers 150-1 to 150-n (n being a natural number greater than 1) corresponding to the decoders 130-1 to 130-n.

Each of the amplifiers 150-1 to 150-n may include a first input terminal 151, a second input terminal 152 and an output terminal 153. For example, the first input terminal 151 may be a positive input terminal and the second input terminal 152 may be a negative input terminal. Thus, in one embodiment, each of the amplifiers 150-1 to 150-n may comprise a differential amplifier.

Alternatively, each of the amplifiers 150-1 to 150-n may comprise or be implemented by a buffer, without being limited thereto. For example, the output terminal of each of the amplifiers 150-1 to 150-n may be connected to the second input terminal 152. The gain of the amplifier may be 1, without being limited thereto.

For example, each of the amplifiers 150-1 to 150-n may receive the analog signal output from one (e.g., a corresponding one) of the plurality of decoders 130-1 to 130-n at the first input terminal 151, amplify or buffer the received analog signal, and output an amplified or buffered signal.

For example, the amplifiers 150-1 to 150-n may amplify or buffer the analog signal output from one (e.g., a corresponding one) of the plurality of decoders 130-1 to 130-n and selected by the multiplexers 140-1 to 140-m, and output an amplified or buffered signal.

Each of the first control switches 161-1 to 161-n may control transmission of the analog signal from one (e.g., a corresponding one) of the plurality of the decoders 130-1 to 130-n to the first input terminal of a corresponding one of the plurality of amplifiers 150-1 to 150-n based on or in response to a corresponding one of the plurality of first control signals S1 to Sn.

Each of the first control switches 161-1 to 161-n may be connected between the first input terminal 151 of each of the amplifiers 150-1 to 150-n and one of the output terminals of the multiplexers 140-1 to 140-m. In addition, each of the first control switches 161-1 to 161-n may be controlled (e.g., turned on or off) by a corresponding one of the plurality of first control signals S1 to Sn.

Each of the second control switches 162-1 to 162-n may be connected between the first input terminal 151 and the second input terminal 152 of a corresponding one of the plurality of amplifiers 150-1 to 150-n (n being a natural number greater than 1). In addition, each of the second control switches 162-1 to 162-n may be controlled (e.g., turned on or off) by a corresponding one of the plurality of second control signals Q1 to Qn. When on or closed, each of the second control switches 162-1 to 162-n may equalize the inputs to the corresponding amplifier 150-1 to 150-n (e.g., When the corresponding first switch 161-1 to 161-n is off or disconnected) and/or bypass the amplifier 150-1 to 150-n (e.g., equalize the first input 151 to the output 153 of the corresponding amplifier 150-1 to 150-n).

Each of the output switches 171-1 to 171-n (n being a natural number greater than 1) may be connected between the output terminal 153 of a corresponding one of the plurality of amplifiers 150-1 to 150-n (n being a natural number greater than 1) and a corresponding one of the plurality of output pins P1 to Pn.

A charge sharing switch 172 may be connected between the output terminals of two neighboring amplifiers (for example, 150-1 and 150-2, 150-(n-1) and 150-n, etc.).

Next, the process or operation of the first control switches 161-1 to 161-n and the second control switches 162-1 to 162-n is described.

Figure 2:
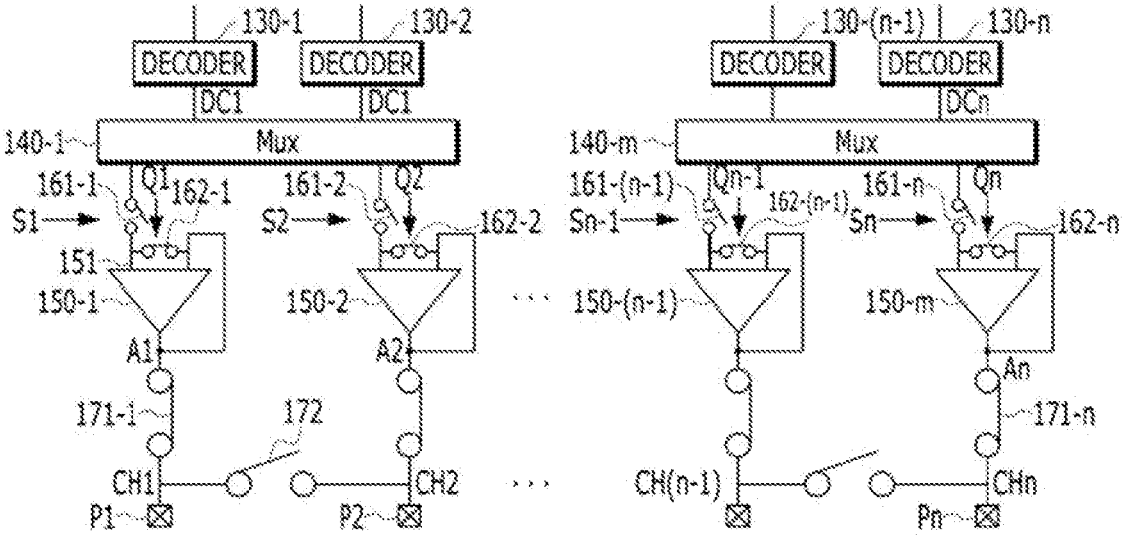
FIG. 2 is a diagram showing an exemplary first process or operation of first control switches and second control switches in the exemplary source driver according to one or more embodiments of the invention.

FIG. 2 is a diagram showing an exemplary first process or operation of the first control switches 161-1 to 161-n and the second control switches 162-1 to 162-n of the exemplary source driver 100 (FIG. 1) according to one or more embodiments of the present invention.

Referring to FIG. 2, the first process or operation may indicate an operation state of the first control switches 161-1 to 161-n and the second control switches 162-1 to 162-n when a latch enable signal En is not enabled.

For example, the latch enable signal En may also be referred to as a latch synchronization signal or a source output enable signal (SOE). The latch enable signal En may be a signal configured to control a period in which the source driver 100 (of FIG. 1) provides drive signals to the data lines of the display panel (see, e.g., FIG. 7).

In the first process or operation, the first control switches 161-1 to 161-n may all be turned off in response to the first control signals S1 to Sn, and the second control switches 162-1 to 162-n may all be turned on in response to the second control signals Q1 to Qn.

For example, when the latch enable signal En is at a first level (e.g., a low level), the first control switches 161-1 to 161-n may all be turned off and the second control switches 162-1 to 162-n may all be turned on, without being limited thereto. This effectively equalizes the inputs to the amplifiers 150-1 to 150-n.

In another embodiment, when the latch enable signal En is at a second level (e.g., a high level), the first control switches 161-1 to 161-n and the second control switches 162-1 to 162-n may perform the first process or operation.

In the first process or operation, the first control switches 161-1 to 161-n and the second control switches 162-1 to 162-n may enter an initialization state (e.g., in which the inputs to the amplifiers 150-1 to 150-n are equalized), as described above.

In the first process or operation, signals are not provided to the first input terminals 151 of the amplifiers 150-1 to 150-n, and the first input terminals 151 and the output terminals 153 (of FIG. 1) of the amplifiers 150-1 to 150-n may be short-circuited or equalized.

In the first process or operation, even when the first input terminals 151 of the amplifiers 150-1 to 150-n are floating (e.g., by disconnecting the first control switches 161-1 to 161-n) and the first input terminals 151 and the output terminals Al-An (i.e., 153 in FIG. 1) of the amplifiers 150-1 to 150-n are short-circuited or equalized by closing or turning on the second control switches, it is possible to prevent the outputs of the amplifiers 150-1 to 150-n from oscillating.

In addition, in the first process or operation, the outputs of the amplifiers 150-1 to 150-n may stably maintain the current values in or of the large panel load of the panel 201 (of FIG. 7), as viewed from the output terminals of the amplifiers 150-1 to 150-n.

Figure 3A:
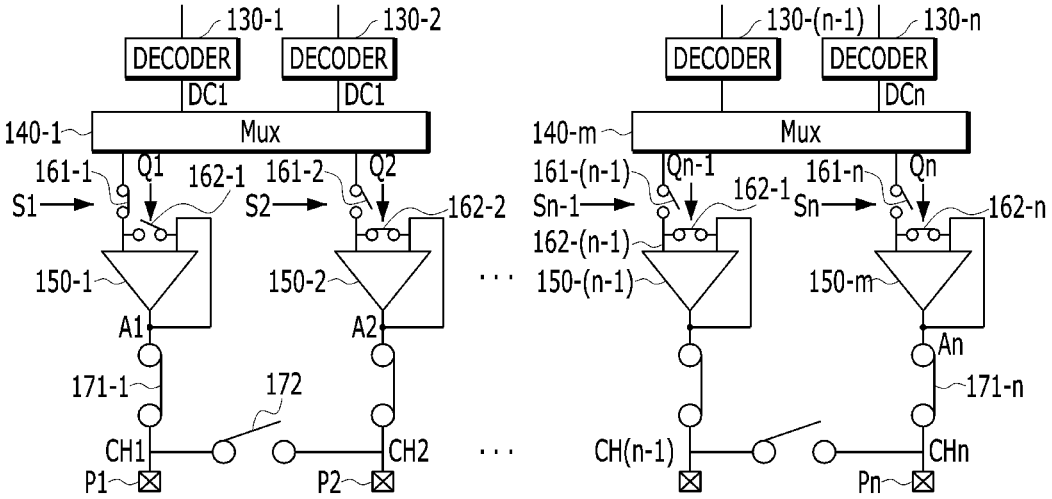
FIGS. 3A and 3B are diagrams showing exemplary second processes or operations of first control switches and second control switches in the exemplary source driver according to one or more embodiments of the invention.
Figure 3B:
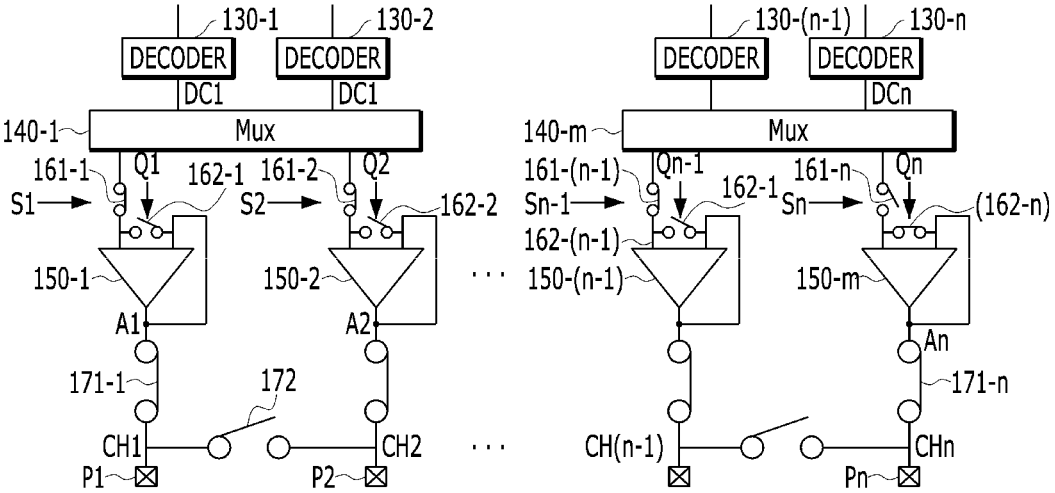

FIGS. 3A and 3B are diagrams showing an exemplary second process or operation of the first control switches 161-1 to 161-n and the second control switches 162-1 to 162-n of the exemplary source driver 100 (FIG. 1) according to one or more embodiments of the present invention.

Figure 7:
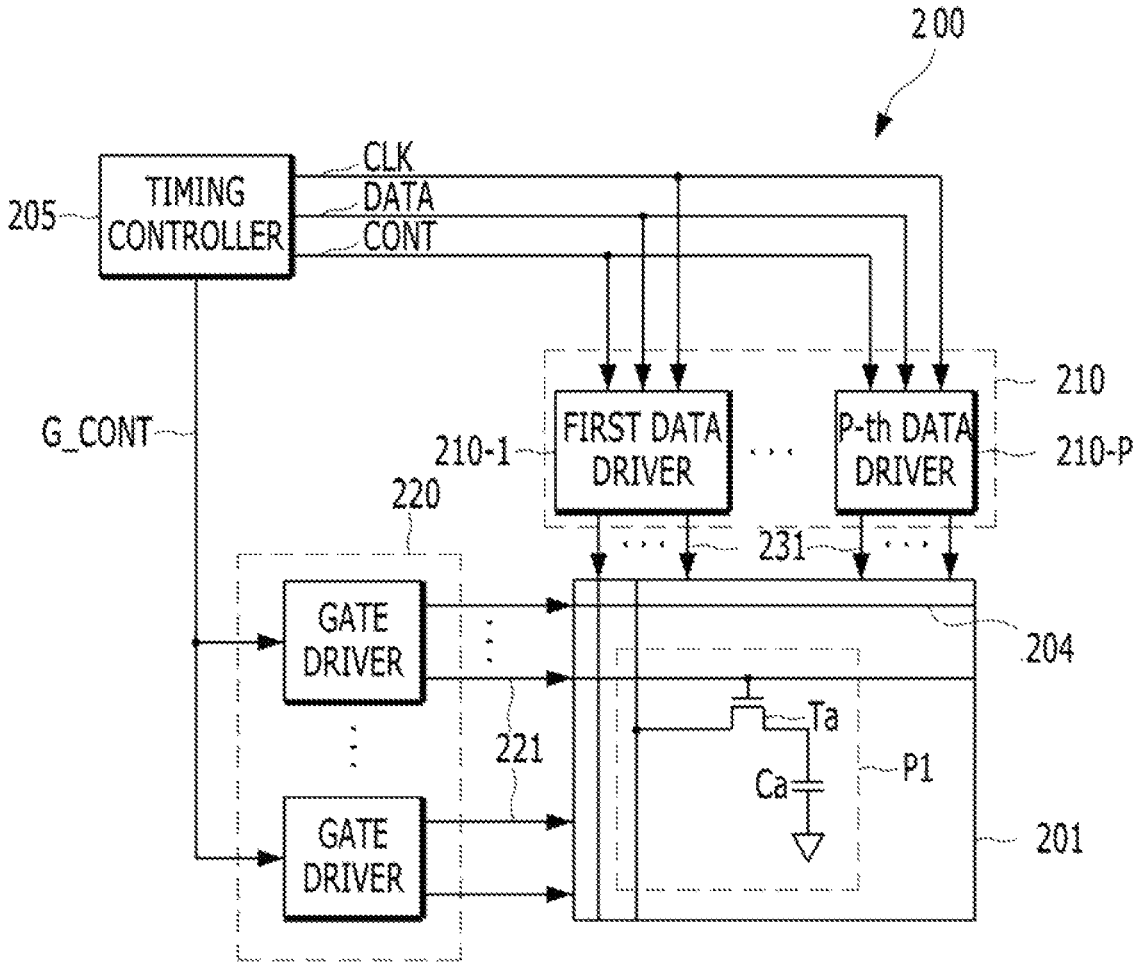
FIG. 7 is a diagram showing an exemplary display apparatus according to one or more embodiments of the invention.

Referring to FIGS. 3A and 3B, the second process or operation occurs during a data driving period of the source driver 100 (e.g., for one line of the panel 201 of FIG. 7).

In response to the latch signals LS1 to LSn (n being a natural number greater than 1; see FIG. 1), the latches 110-1 to 110-n corresponding to the channels CH1 to CHn (n being a natural number greater than 1; see FIG. 1) of the source driver 100 may sequentially operate.

When the latch enable signal En is at a second level (for example, a high level), the second process or operation may be performed. The levels of the latch enable signal En that perform or control the first process or operation and the second process or operation may be reverse to those described in various embodiments above.

In the second process or operation, the first control signals S1 to Sn (FIG. 3B) may be based on or generated in response to the latch signals LS1 to LSn (n being a natural number greater than 1). For example, the first control signals S1 to Sn may be synchronized with the latch signals LS1 to LSn (n being a natural number greater than 1).

Each of the first control signals S1 to Sn may be generated such that a corresponding one of the plurality of first control switches 161-1 to 161-n is turned on when a corresponding one of the plurality of latch signals LS1 to LSn has a first level (e.g., a low binary logic level) enabling storing data in and/or outputting data from the corresponding latch.

The channels CH1 to CHn of the source driver 100 (FIG. 1) may sequentially operate or sequentially drive the data lines of the panel 201 (FIG. 7) using the latch signals LS1 to LSn (FIG. 1).

FIG. 3A shows the process or operation of the first control switch 161-1 and the second control switch 162-1 when the data in the first latch unit 110-1 (FIG. 1) of the first channel CH1 is transmitted to the first decoder 130-1 in response to the first latch signal LS1, and the first decoder 130-1 operates using the data from the first latch unit 110-1.

Referring to FIG. 3A, the first control switch 161-1 of the first channel CH1 may be turned on in response to the first control signal S1, in turn based on or generated in response to the first latch signal LS1 (FIG. 1), and the second control switch 162-1 of the first channel CH1 may be turned off in response to the second control signal Q1, also based on or generated in response to the first latch signal LS1.

At this time, the first control switches 161-1 to 161-n of the remaining channels CH2 to CHn may be turned off, and the second control switches 162-2 to 162-n may be turned on.

In the second process or operation, the first control switches 161-1 to 161-n corresponding to the channels CH1 to CHn may be sequentially turned on in response to the first control signals S1 to Sn, which are, in turn, based on or generated in response to the latch signals LS1 to LSn, and the second control switches 162-1 to 162-n may be sequentially turned off in response to the second control signals Q1 to Qn, which are also based on or generated in response to the latch signals LS1 to LSn.

FIG. 3B shows the process or operation of the first control switches 161-1 to 161-n and the second control switches 162-1 to 162-n when the first to (n-1)-th channels CH1 to CH(n-1) sequentially process or operate and the n-th latch signal LSn (FIG. 1) is not yet input to the n-th channel CHn.

Referring to FIG. 3B, the first control switches 161-1 to 161-(n-1)) may be turned on, and the first control switch 161-n may be turned off. In addition, the second control switches 161-1 to 161-(n-1)) may be turned off, and the second control switch 162-n may be turned on.

For example, the first control switches 161-1 to 161-n may operate at the same time or during the same or substantially the same time interval as the delay of the latch signals LS1 to LSn (FIG. 1), the process or operation may be released when the latch signals LS1 to LSn are input (e.g., to the second latches 114-1 to 114-n), and the amplifiers 150-1 to 150-n may output the buffered and/or amplified signal in a static driving state of the source driver 100.

When a first driver among the plurality of drivers performs a decoding process or operation and selects one of the plurality of grayscale voltages based on or in response to data from the latch of the first driver (which is, in turn, based on or in response to a corresponding one of the plurality of latch signals), the first control switch of the first driver may be turned on, and the second control switch of the first driver may be turned off.

In contrast, the first control switch of the second driver among the plurality of drivers may be turned off and the second control switch of the second driver may be turned on. The latch of the second driver may not receive a corresponding latch signal. In such a case, since the data is not transmitted from the latch unit to the decoder of the second driver, the decoder of the second driver may not perform the decoding process or operation.

Figure 4:
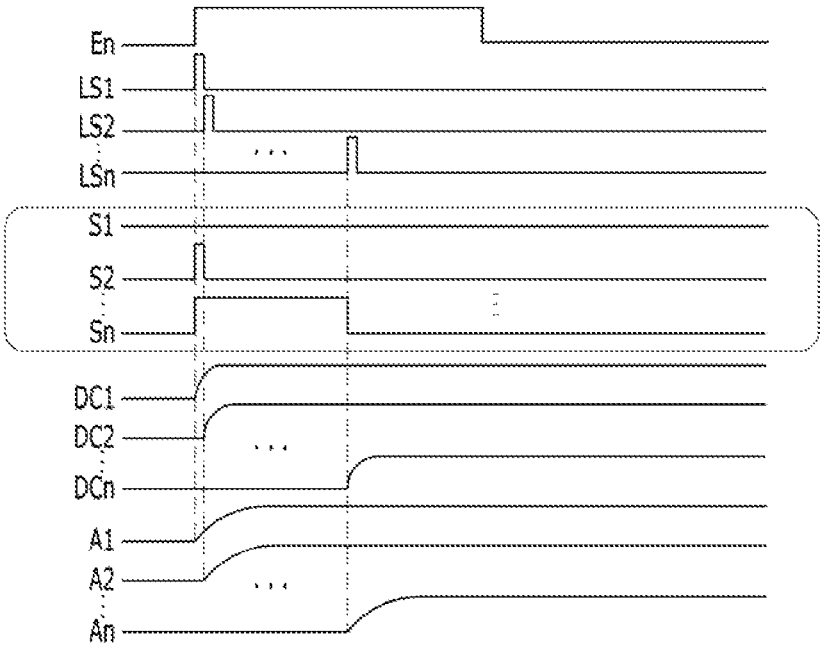
FIG. 4 is a timing chart illustrating an exemplary process or operation of first control switches according to one or more embodiments of the invention.

FIG. 4 is a timing chart illustrating the process(es) and/or operation(s) of the first control switches 161-1 to 161-n (FIG. 1) according to one or more embodiments of the present invention.

Referring to FIG. 4, in the second process or operation, the first control signals S1 to Sn may be based on or generated in response to the latch signals LS1 to LSn (FIG. 1).

Although not shown in FIG. 4, each of the second control signals Q1 to Qn (FIGS. 2 and 3A-B) may be an inverted signal of a corresponding one of the plurality of first control signals (e.g., the corresponding inverted first control signal). For example, when the first control switches 161-1 to 161-n (FIG. 1) of the channels CH1 to CHn are turned on, the second control switches 162-1 to 162-n may be turned off and, when the first control switches 161-1 to 161-n are turned off, the second control switches 162-1 to 162-n may be turned on.

Figure 5:
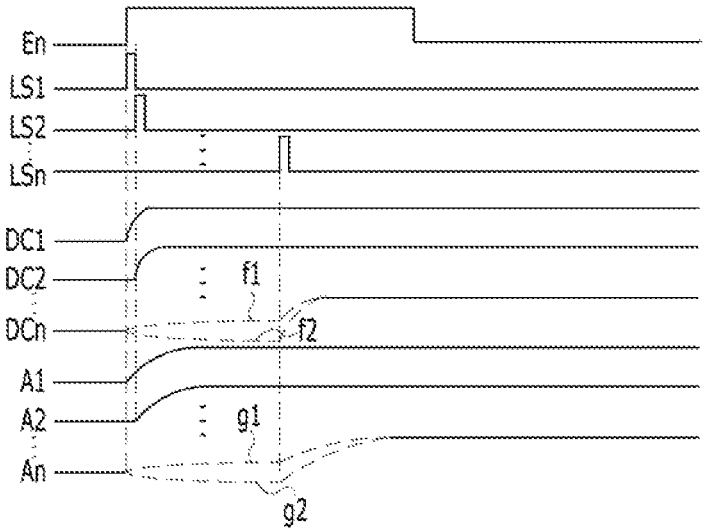
FIG. 5 is a timing diagram showing the outputs of decoders and the outputs of amplifiers when the first control switches and the second control switches are not in the source driver of FIG. 1.

FIG. 5 is a diagram showing the outputs DC1 to DCn of the decoders and the outputs A1 to An of the amplifiers when the first control switches 161-1 to 161-n and the second control switches 162-1 to 162-n (FIG. 1) are not present in the source driver 100 of FIG. 1.

Referring to FIG. 5, since the decoders 130-1 to 130-n use a common resistor string, the voltages in and output from common resistor string fluctuate due to short circuits that occur when the decoders select the grayscale voltages. This may result from inaccurate switching times of the switches in the decoders 130-1 to 130-n.

While the channels CH1 to CHn may sequentially operate and/or transmit data in response to the latch signals LS1 to LSn, the voltages from the common resistor string may continue to fluctuate and may not be maintained accurately, thereby distorting the output signals of the decoders and the output signals of the amplifiers.

The output signals DC1 to DCn of the decoders may have an overdamping waveform, shown as f1 in FIG. 5. The waveform g1 (signal An) indicates that the output signals of the amplifiers A1 to An have an overdamping waveform.

The output signals DC1 to DCn of the decoders may have an underdamping waveform, shown as f2 in FIG. 5. The waveform g2 (signal An) indicates that the output signals of the amplifiers A1 to An have an underdamping waveform.

Referring back to FIG. 4, using the process(es) or operation(s) of the first control switches 161-1 to 161-n and the second control switches 162-1 to 162-n, waveform distortion does not occur in the output signals DC1 to DCn of the decoders 130-1 to 130-n and the output signals A1 to An of the amplifiers 150-1 to 150-n.

Therefore, according to one or more embodiments of the present invention, it is possible to remove distortion of the output signals A1 to An of the amplifiers (e.g., amplifiers 150-1 to 150-n in FIG. 1), which may occur due to switching of the switches included in the decoders 130-1 to 130-n and to stably maintain the output signals A1 to An of the amplifiers 150-1 to 150-n during a latch delay time. The latch delay time may be a period in which the latch enable signal En is at the second level (for example, a high binary logic level) in FIG. 4, without being limited thereto.

Figure 6:
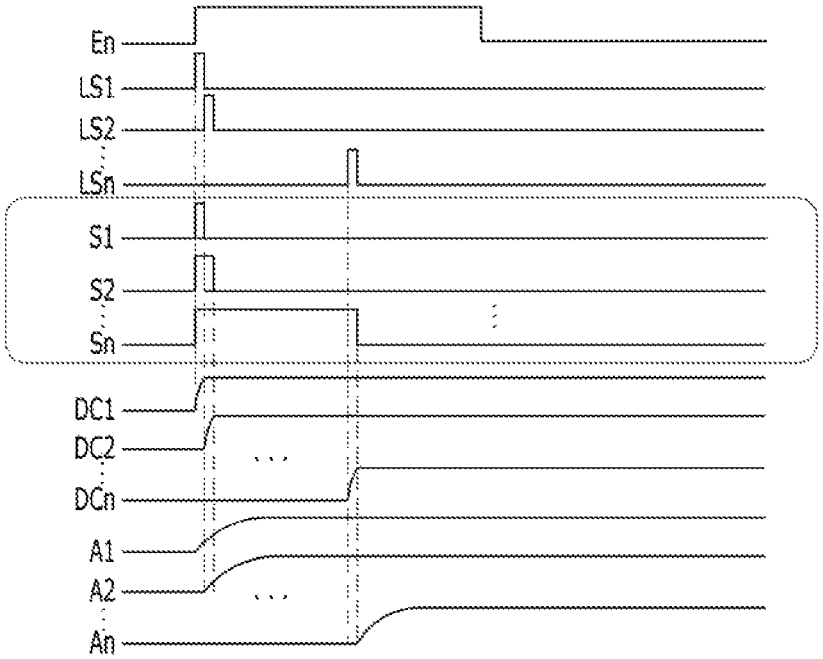
FIG. 6 is a timing chart illustrating one or more processes or operations of first control switches according to one or more embodiments of the invention.

FIG. 6 is a timing chart illustrating one or more processes or operations of the first control switches 161-1 to 161-n (FIGS. 1-3B) according to one or more embodiments of the present invention.

Referring to FIG. 6, each of the first control signals S1 to Sn may be delayed from a corresponding one of the plurality of latch signals LS1 to LSn (FIG. 1) by a predetermined time. Alternatively, each of the first control signals S1 to Sn may be asserted (e.g., changed to an active state) simultaneously or substantially simultaneously with assertion of a first one of the plurality of latch signals (e.g., LS1), maintained until the corresponding latch signal is asserted, and deasserted simultaneously or substantially simultaneously with deassertion of the corresponding latch signal.

For example, the predetermined time may be equal to or less than a time difference between two neighboring latch signals (for example, LS1 and LS2).

For example, the n-th control signal Sn may be activated in synchronization with the (n-1)-th latch signal LS(n-1).

Although not shown in FIG. 6, the second control signals Q1 to Qn (FIGS. 2 and 3A-3B) may be the inverted first control signals S1 to Sn shown in FIG. 6 (e.g., S1, S2, . . . Sn).

That is, in the second process or operation, when the first control switch (for example, 161-1) is turned off in response to the first control signal (e.g., S1), the process or operation of the latch (e.g., 110-1) and the decoder (for example, 130-1) in each channel (for example, CH1) may be started in response to the latch signal (for example, LS1). To this end, the output (for example, DC1) of the decoder (for example, 130-1) may not be connected to the first input terminal of the amplifier (for example, 150-1), and a load applied to the output terminal of the decoder (for example, 130-1) is removed. Thus, the output of the decoder (for example, 130-1) may swing, in some instances rapidly. As a result, the slew rate of the output (for example, DC1) of the decoder (for example, 130-1) may increase and rapidly settle.

After the output (for example, DC1) of the decoder (for example, 130-1) settles, the amplifier (for example, 150-1) may receive the settled output signal of the decoder (for example, 130-1). Therefore, output deviations from the decoders 130-1 to 130-n may disappear, and thus, output deviation from the amplifiers 150-1 to 150-n may also be reduced.

In a decoder to which interpolation is applied, a difference in the slew rate of the decoder output between neighboring even-numbered and odd-numbered interpolated rows or columns of grayscale data may occur according to the difference in loads on the rows or columns when viewed from the output of the decoder. Thus, a gray inversion phenomenon between the neighboring even-numbered and odd-numbered interpolated rows or columns of grayscale data may occur, thereby causing a malfunction (e.g., of the decoder). The gray inversion phenomenon may mean that gray having a low level or intensity has a higher voltage than gray having a high level or intensity.

Through the timing of control signals to the first control switches 161-1 to 161-n and the second control switches 162-1 to 162-n having respective inverted states, the slew rates of the output signals DC1 to DCn of the decoders 130-1 to 130-n may increase, and the output signals DC1 to DCn of the decoders 130-1 to 130-n may rapidly settle. Therefore, according to one or more embodiments of the present invention, it is possible to (i) prevent the gray inversion phenomenon which may be generated in the source driver including decoders to which interpolation is applied from affecting the output signals of the amplifiers, (ii) prevent the output signals of the amplifiers from being distorted, and (iii) suppress deviations between the output signals of the amplifiers.

FIG. 7 is a diagram showing a display apparatus 200 according to one or more embodiments of the present invention.

Referring to FIG. 7, the display apparatus 200 includes a display panel 201, a timing controller 205, a data driver unit 210 and a gate driver unit 220.

The display panel 201 includes gate lines 221 forming rows and data lines 231 forming columns, both of which intersect to form a matrix, and pixels connected to the intersecting gate lines and data lines.

The pixels may be connected to the gate lines 221 and the data lines 231 and may be in a matrix having rows and columns.

Each pixel may include a transistor Ta connected to the gate line and the data line and a capacitor Ca connected to the transistor Ta.

For example, each pixel may include a R (red) sub-pixel, a G (green) sub-pixel, and a B (blue) sub-pixel, and each of the R, G, B sub-pixels may include a transistor Ta connected to the gate line and the data line and a capacitor Ca connected to the transistor Ta.

The timing controller 205 may output a clock signal CLK, data DATA, a control signal CONT configured to control the data driver unit 210, and a control signal G_CONT configured to control the gate driver unit 220.

Although the clock signal CLK, the data DATA, and the first control signal CONT are transmitted to the drivers 210-1 to 210-P through three transmission lines, as shown in FIG. 7, the present invention is not limited thereto. In another embodiment, the clock signal CLK, the data DATA, and the control signal CONT may be transmitted to the drivers 210-1 to 210-P through one transmission line at or over various time intervals (e.g., using time division).

For example, the control signal CONT may include a horizontal start signal, an enable signal En and a clock signal CLK input to the shift register of the source driver.

In addition, for example, the control signal G_CONT may include a gate drive signal configured to enable driving the gate lines 221.

The gate driver unit 220 may drive the gate lines 221, include a plurality of gate drivers, and output gate drive signals configured to control (e.g., turn on and off) the transistors Ta of the pixels to the gate lines 221.

The data driver unit 210 may drive the data lines or the channels 231 of the display panel and may include a plurality of data drivers 210-1 to 210-P (P being a natural number greater than 1). The number of the data drivers 210-1 to 210-P (P being a natural number greater than 1) may be equal to the number of output pins P1 to Pn in the source driver 100 of FIG. 1 according to one or more embodiments of the present invention.

According to one or more embodiments of the present invention, it is possible to prevent output distortion in a signal from a decoder and/or an amplifier due to fluctuations in a resistor string as a result of a decoder switching process or operation that may occur when a latch signal is transmitted to a channel in response to a latch enable signal.

According to various embodiments of the present invention, it may be possible to prevent a gray inversion phenomenon between neighboring even-numbered and odd-numbered rows and columns of interpolated grayscale data (which may be generated using a decoder to which interpolation is applied) from affecting the output of the amplifier.

Characteristics, structures, effects, and so on described in the above embodiments are included in at least one of the embodiments, but are not limited to only one embodiment. Furthermore, it is apparent that the features, structures, effects, and so on described in the various embodiments can be combined or modified with one or more embodiments of the present invention by persons skilled in the art. Therefore, it should be understood that the contents relevant to such combination and modification fall within the scope of the present invention.

What is claimed is:

1. A source driver, comprising:

a latch configured to store data based on or in response to a latch signal and output the data stored in the latch;

a resistor string including a plurality of resistors configured to provide a plurality of grayscale voltages;

a decoder connected to the resistor string, configured to select and output one of the plurality of grayscale voltages based on or in response to the data from the latch and including a plurality of switches connected to the resistor string, the plurality of switches being configured to select one of the plurality grayscale voltages based on or in response to the data stored in the latch;

an amplifier including a first input terminal, a second input terminal and an output terminal;

a first control switch connected between the decoder and the first input terminal of the amplifier; and a second control switch connected between the first input terminal and the second input terminal of the amplifier;

an output pin; and an output switch connected between the output pin and the output terminal of the amplifier, wherein the first control switch and the second control switch are alternately turned on and off, and the output switch is turned on when the latch is enabled.

2. The source driver according to claim 1, wherein the first control switch is controlled by a first control signal and the second control switch is controlled by a second control signal that is an inverted first control signal.

3. The source driver according to claim 1, wherein the first control switch is controlled by a first control signal synchronized with the latch signal.

4. The source driver according to claim 1, wherein the first control switch is controlled by a first control signal delayed from the latch signal by a predetermined delay time.

5. The source driver according to claim 1, wherein the amplifier is or comprises a buffer, and the second input terminal and the output terminal are connected.

6. A display apparatus comprising:

a display panel including gate lines, data lines, and pixels connected to the gate lines and the data lines, the pixels being in a matrix including rows and columns;

a data driver configured to drive the data lines; and a gate driver configured to drive the gate lines, wherein the data driver is the source driver, according to claim 1.

7. A source driver, comprising:

a plurality of pins;

a resistor string including a plurality of resistors configured to provide a plurality of grayscale voltages; and a plurality of drivers configured to provide drive signals to the plurality of pins, wherein each of the plurality of drivers includes:

a latch configured to store data based on or in response to a corresponding one of a plurality of latch signals and output the data stored in the latch;

a decoder connected to the resistor string to select and output one of the plurality of grayscale voltages based on or in response to the data from the latch;

an amplifier including a first input terminal, a second input terminal and an output terminal;

a first control switch connected between an output of the decoder and the first input terminal of the amplifier; and a second control switch connected between the first input terminal and the second input terminal of the amplifier, wherein a first control switch of each of the drivers is controlled by a first control signal based on or generated in response to a corresponding one of the plurality of latch signals, and the first control switch and the second control switch in the plurality of drivers are alternately turned on and off.

8. The source driver according to claim 7, wherein the first control signal is synchronized with the corresponding latch signal.

9. The source driver according to claim 7, wherein the first control signal is delayed from the corresponding latch signal by a predetermined delay time.

10. The source driver according to claim 7, wherein the decoder includes a plurality of switches connected to the resistor string, and the plurality of switches is configured to select one of the plurality of grayscale voltages based on or in response to the data from the latch.

11. The source driver according to claim 10, further comprising:

an output pin corresponding to each of the plurality of drivers; and an output switch connected between the output terminal of the amplifier of the corresponding one of the plurality of drivers and the corresponding output pin, wherein the output switch is turned on when the latch is enabled.

12. The source driver according to claim 11, wherein, in a first process or operation, the first control switch in each of the plurality of drivers is turned off, and the second control switch in each of the plurality of drivers is turned on.

13. The source driver according to claim 12, wherein, in a second process or operation subsequent to the first process or operation, the first control switches are sequentially turned on, and the second control switches are sequentially turned off.

14. The source driver according to claim 13, wherein the first process or operation is performed while the latch is not enabled.

15. The source driver according to claim 14, wherein the second process or operation is performed while the latch is enabled.

16. The source driver according to claim 7, further comprising a multiplexer configured to provide (i) an output of one of the decoders from two of the plurality of drivers to one of the amplifiers in the two drivers and (ii) an output of the other of the two decoders to the other of the amplifiers in the two drivers.

17. The source driver according to claim 7, wherein:

when a first driver of the plurality of drivers selects one of the plurality of grayscale voltages, the first control switch of the first driver is turned on and the second control switch of the first driver is turned off, the first control switch of a second driver of the plurality of drivers is turned off and the second control switch of the second driver is turned on, and the latch of the second driver does not receive a corresponding one of the plurality of latch signals.

18. The source driver according to claim 7, wherein each of the plurality of drivers further includes a level shifter configured to shift a level of the data from the latch and output the level-shifted data to the decoder.

* * * * *